US007163304B2

(12) United States Patent
Cohen et al.

(10) Patent No.: US 7,163,304 B2
(45) Date of Patent: Jan. 16, 2007

(54) CHANGEABLE-APPEARANCE DEVICE PARTICULARLY USEFUL AS A CHEMILUMINSCENT VESSEL

(76) Inventors: Liran B. Cohen, 17 HaPrachim Street, RaAnana (IL) 43399; Alon Brand, Kfar Monash, Kfar Monash (IL) 42875

( * ) Notice: Subject to any disclaimer, the term of this patent is extended or adjusted under 35 U.S.C. 154(b) by 39 days.

(21) Appl. No.: 11/139,524

(22) Filed: May 31, 2005

(65) Prior Publication Data

US 2005/0270762 A1 Dec. 8, 2005

Related U.S. Application Data

(63) Continuation-in-part of application No. 11/105,432, filed on Apr. 14, 2005, now Pat. No. 7,021,781, which is a continuation of application No. 10/700,830, filed on Nov. 4, 2003, now Pat. No. 7,017,736.

(51) Int. Cl.
*F21K 2/00* (2006.01)

(52) U.S. Cl. ..... 362/34; 362/101

(58) Field of Classification Search ..... 362/34, 362/101; 206/217, 222; 62/331, 457.1, 62/457.3, 457.5

See application file for complete search history.

(56) References Cited

U.S. PATENT DOCUMENTS

| | | | | |
|---|---|---|---|---|
| 5,171,081 | A * | 12/1992 | Pita et al. | 362/34 |
| 6,062,380 | A * | 5/2000 | Dorney | 206/217 |
| 6,474,467 | B1 * | 11/2002 | Kurdian | 206/222 |
| 6,520,657 | B1 * | 2/2003 | DeNicola | 362/34 |
| 7,017,736 | B1 * | 3/2006 | Cohen et al. | 206/222 |
| 7,021,781 | B1 * | 4/2006 | Cohen et al. | 362/34 |

* cited by examiner

*Primary Examiner*—Ali Alavi

(57) ABSTRACT

A changeable-appearance device includes an inner container open at the top and closed at the bottom by a bottom wall, and an outer light-transmissive container open at the top and receiving the inner container with an annular space between the two containers. The outer container includes a base closing its bottom and defining a compartment with the bottom wall of the inner container. The compartment includes one or more ampules containing a changeable-appearance substance effective, when an ampules is ruptured, to release its respective substance into the annular space between the two containers. One of the containers includes an ampule-engaging element effective, upon rotation of one container with respect to the other, to engage and rupture the ampule, and thereby to release the substance in the annular space between the two containers. In the described preferred embodiment, the changeable-appearance substance released from the ampule is a chemiluminscent substance producing a chemiluminscent glow, but may be an effervescent substance to produce an ornamental effervescent appearance, or a color-changing substance to produce an indication of a previous opening of the device.

24 Claims, 6 Drawing Sheets

CHANGEABLE-APPEARANCE DEVICE PARTICULARLY USEFUL AS A CHEMILUMINSCENT VESSEL

RELATED APPLICATIONS

The present application is a continuation-in-part of U.S. patent application Ser. No. 11/105,432, filed Apr. 14, 2005, now U.S. Pat. No. 7,021,781 which is a continuation of U.S. patent application Ser. No. 10/700,830, filed Nov. 4, 2003, now U.S. Pat. No. 7,017,736 the contents of which are incorporated herein by reference.

FIELD AND BACKGROUND OF THE PRESENT INVENTION

The present invention relates to changeable-appearance devices, and particularly to chemiluminscent devices in which an ornamental effect is produced by interacting chemiluminscent fluids to produce a luminous glow. The invention is therefore described below with respect to such an application, but it will be appreciated that the invention could also be implemented in other changeable appearance devices as described more particularly below.

Many types of chemiluminscent devices or vessels are known in the prior art wherein two cheniiluminscent fluids are mixed together to produce a luminous glow. Examples of chemiluminscent bottles are described in U.S. Pat. Nos. 6,474,467 and 6,520,657; examples of chemiluminscent cups, glasses, coasters, etc. are described in U.S. Pat. Nos. 5,171,081, 6,676,269, 5,552,968, 6,082,866 and 6,062,380; and examples of other types of chemilumninscent devices are described in U.S. Pat. Nos. 3,813,534, 3,819,925, 5,381, 311, 5,488,544, 5,508,893 and 5,709,449.

OBJECTS AND BRIEF SUMMARY OF THE PRESENT INVENTION

An object of the present invention is to provide a novel changeable-appearance device, and particularly a novel chemiluminscent device, having a number of advantages over the prior art, as will be described more particularly below.

According to one aspect of the present invention, there is provided a changeable-appearance ornamental device, comprising an inner container open at the top and closed at the bottom by a bottom wall; and an outer light-transmissive container open at the top and sized for receiving the inner container with an annular space between the two containers. The outer container includes a base closing its bottom and defining a compartment with the bottom wall of the inner container for receiving at least one rupturable ampule containing a substance capable of producing a change in appearance of the device when the ampule is ruptured. At least one of the containers includes an ampule-engaging element located within the compartment and effective, upon rotation of one of the containers with respect to the other, to engage and rupture the ampule therein and thereby to release the appearance-changing substance into the annular space between the two containers.

Such a construction thus provides a convenient means for activating the device in order to produce a changed appearance in the device.

In the preferred embodiment of the invention, as illustrated in the accompanying drawings and as to be more particularly described below, the changeable-appearance substance which, when released, produces a change in appearance of the device, is a chemiluminscent substance producing a chemiluminscent glow.

According to another aspect of the present invention, therefore, there is provided a chemiluminscent device, comprising an inner container open at the top to receive a beverage or other liquid, and closed at the bottom by a bottom wall; and an outer light-transmissive container open at the top and sized for receiving the inner container with an annular space between the two containers. The outer container includes a base closing its bottom and defining a compartment with the bottom wall of the inner container. This device further includes at least one rupturable ampule in the compartment and containing a chemiluminscent fluid. One of the containers includes an ampule-engaging element effective, upon rotation of one container with respect to the other container, to engage and rupture the ampule, and thereby to release the chemiluminscent fluid in the annular space between the two containers.

While the invention is particularly useful in producing a chemiluminscent "glow" effect, the invention could be used for producing other effects by providing the ampule or ampules with the appropriate changeable-appearance substance. For example, the changeable-appearance substance within the ampules could produce a bubbling or effervescent effect in the annular space between the two containers by using an appropriate effervescent substance within the ampules. The changeable-appearance substance within the ampules could also produce a color changing effect to indicate a previous opening of the device useful in, for example, tamper-proof containers containing medications, food, etc.

Further features and advantages of the invention will be apparent from the description below.

BRIEF DESCRIPTION OF THE DRAWINGS

The invention is herein described, by way of example only, with reference to the accompanying drawings, wherein.

It is to be understood that the foregoing drawings, and the description below, are provided primarily for purposes of facilitating understanding the conceptual aspects of the invention and possible embodiments thereof, including what is presently considered to be a preferred embodiment. In the interest of clarity and brevity, no attempt is made to provide more details than necessary to enable one skilled in the art, using routine skill and design, to understand and practice the described invention. It is to be further understood that the embodiments described are for purposes of example only, and that the invention is capable of being embodied in other forms and applications than described herein.

DESCRIPTION OF A PREFERRED EMBODIMENT

The accompanying drawings, and the description below, illustrate the changeable-appearance device of the present invention implemented in a chemiluminscent device in the form of a vessel for receiving a beverage or other liquid, in which an ornamental effect is produced by bringing together two chemiluminscent fluids which, when mixed, interact to produce a luminous glow. Such chemiluminscent devices and fluids are well known, as described for example in the above-cited U.S. Patents.

Figure 4:
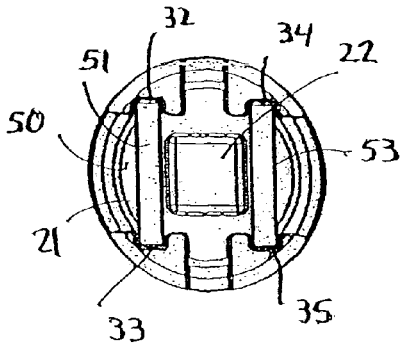
FIG. 4 is a sectional view along line IV—IV of FIG. 3.
Figure 5:
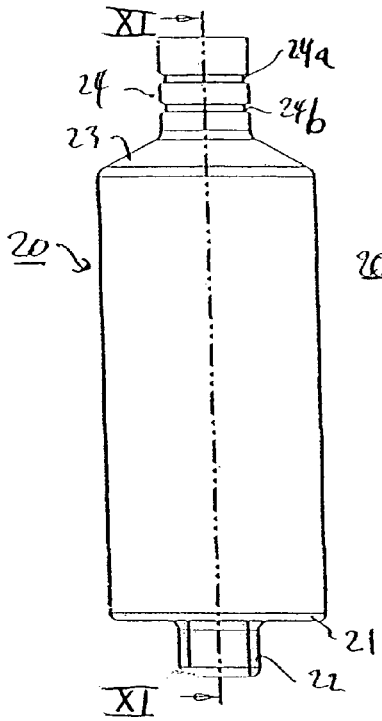
FIG. 5 is a side-elevational view illustrating only the inner container in the device of FIGS. 1–4.
Figure 6:
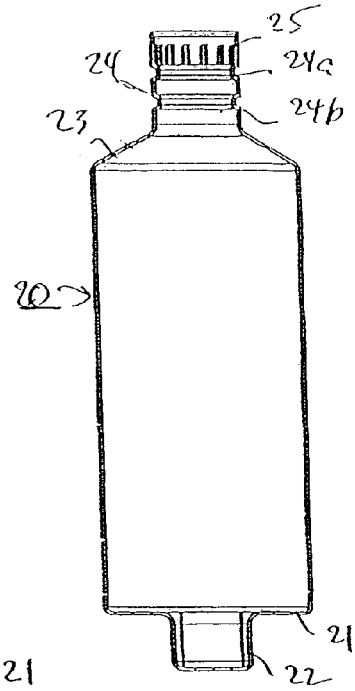
FIG. 6 is a sectional view along line VI—VI of FIG. 5.
Figure 7:
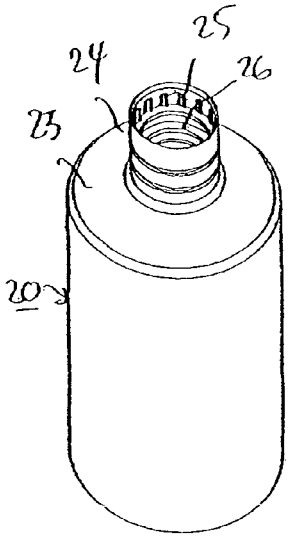
FIGS. 7 and 8 are three dimensional views of the inner container of FIGS. 5 and 6 from the top and bottom, respectively.
Figure 8:
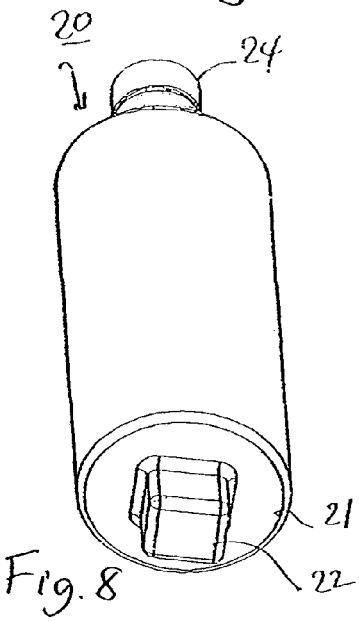
Figure 9:
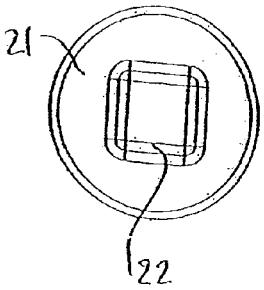
FIG. 9 is a bottom plan view of the inner container of FIGS. 5–8.
Figure 10:
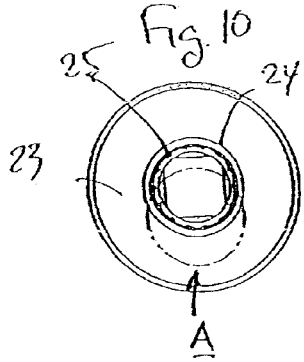
FIG. 10 is a top plan view of the inner container of FIGS. 5–9.
Figure 11:
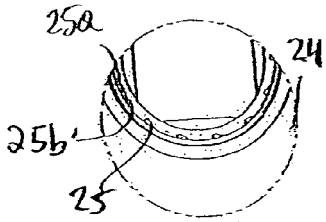
FIG. 11 is an enlarged fragmentary view of the region marked A in FIG. 10.
Figure 12:
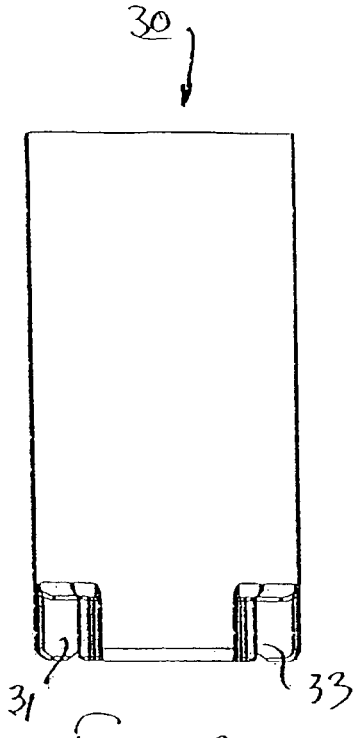
FIG. 12 is a side-elevational view illustrating the outer container in the device of FIGS. 1–4.
Figure 14:
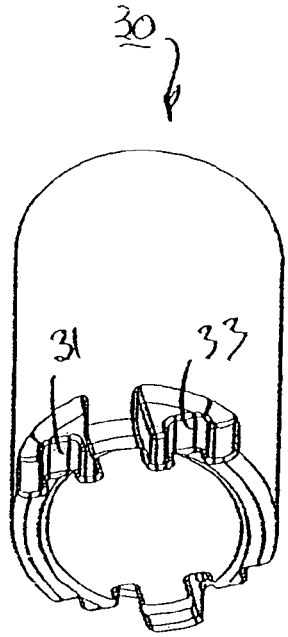
FIGS. 14 and 15 are three-dimensional views, from the top and bottom respectively, of the outer container of FIGS. 12 and 13.
Figure 13:
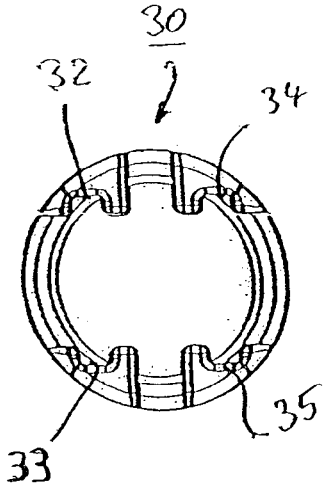
FIG. 13 is a bottom plan view of the outer container of FIG. 12.
Figure 15:
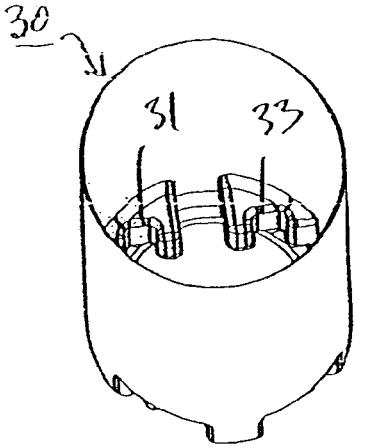

Reference is first made to FIGS. 1–4 illustrating the main components of such a chemiluminscent device, in exploded form (FIG. 1), in assembled form (FIG. 2), in longitudinal section (FIG. 3), and in transverse section through the bottom (FIG. 4).

Figure 1:
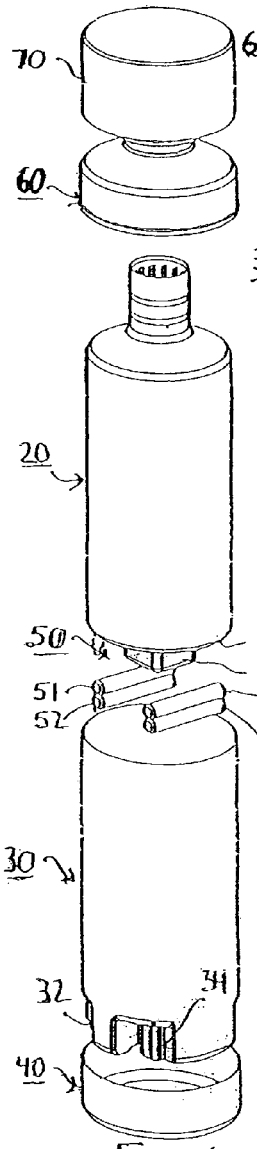
FIG. 1 is an exploded, three-dimensional view, illustrating one form of changeable-appearance device constructed in accordance with the present invention.
Figure 2:
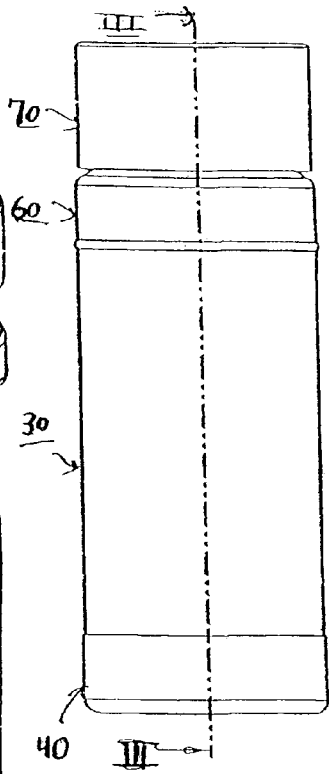
FIG. 2 is a side-elevational view of the device of FIG. 1 in assembled condition.
Figure 3:
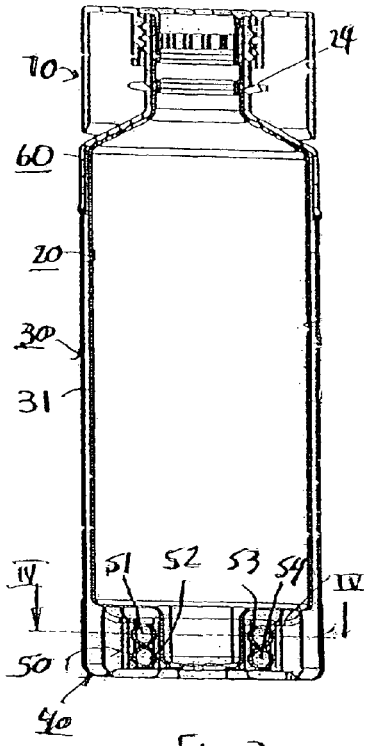
FIG. 3 is a sectional view along line III—III of FIG. 2.

As shown particularly in FIG. 1, the chemiluminscent device includes an inner container 20 open at the top to receive a beverage or other liquid, and closed at the bottom by bottom wall 21 integrally formed with an axially-extending projection 22. The illustrated device further includes an outer light-transmissive container 30 open at the top and sized for receiving the inner container 20 with an annular space 31 (FIG. 3) between the two containers. Outer container 30 further includes a base 40 closing its bottom and thereby serving as its bottom wall. Base 40 defines, with bottom wall 21 of the inner container 20, a compartment 50 for receiving a plurality of rupturable ampules 51–54 containing changeable-appearance fluids, in this case a first chemiluminscent fluid which, when released, reacts with another chemiluminscent fluid within annular space 31 to produce a "luminous glow". The illustrated chemiluminscent device further includes an intermediate coupling member 60 attachable to the upper end of inner container 20 for coupling it to an outer cap assembly 70.

As will be described more particularly below, the outer cap assembly 70 includes a cap adapted to close the open end of the inner container 20, and also to define a one-way coupling with the inner container 20. The one-way coupling is such that when the cap assembly is rotated in one direction it first rotates inner container 20, and thereby projection 22 within compartment 50 to engage and rupture the ampules 51–54 within that compartment, and then permits the cap assembly to be removed from the inner compartment; whereas the cap assembly may be freely rotated in the opposite direction to permit reapplication of the cap assembly to the inner container.

The structure of the inner container 20 is more particularly illustrated in FIGS. 5–11. As described above, it is closed at the bottom by bottom wall 21 integrally formed with a projection 22 which projects into the ampule compartment 50. Projection 22 is preferably of square cross-section for a reason to be described more particularly below.

The upper end of inner container 20 is shaped to define a conical section 23 terminating in a neck 24 formed on its outer surface with a pair of annular ribs 24*a*, 24*b*. As shown particularly in FIG. 7, the inner surface of neck 24 is formed at its outer end with an annular array of teeth 25 and with threads 26 inwardly of teeth 25. Teeth 25 are specially shaped to produce the one-way coupling referred to above between the inner container 20 and the outer cap assembly 70. Thus, as shown particularly in FIGS. 10 and 11, each of the teeth 25 is formed with one face 25*a* which is substantially perpendicular to the inner surface of the neck, and an opposite teeth 25*b* which is at an acute angle to the inner surface of the neck.

The inner container 20 may be made of an opaque material (e.g., metal), or of a light-transmissive material to enable viewing its contents, if desired.

The structure of the outer container 30 is more particularly illustrated in FIGS. 12–15. It is made of a light-transmissive material, e.g., transparent or translucent plastic or glass, to enable viewing the chemiluminscent effect produced upon rupturing the ampules 51 as briefly described above, and as more particularly described below. As mentioned above and as shown in FIG. 1 outer container 30 is closed at its bottom by base 40 to define a compartment 50 for receiving the ampules 51. For this purpose, the lower end of the outer container 30 is specially shaped to define a first pair of opposed recesses 32, 33 on one side of its center axis, and a second pair of opposed recesses 34, 35 on the opposite side of its center axis. Each pair of recesses 32, 33 and 34, 35, respectively, serves as a socket for receiving two ampules (FIG. 1). It will thus be seen that when base 40 is removed, one pair of ampules 51–52 may be inserted with a snap-fit into the socket defined by recess 32, 33, and the other pair of ampules 53–54 may similarly be inserted with a snap-fit into the socket defined by recesses 34, 35.

Figure 16:
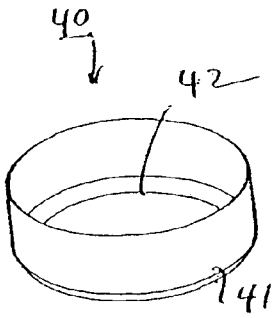
FIG. 16 illustrates the base in the device of FIGS. 1–4.
Figure 17:
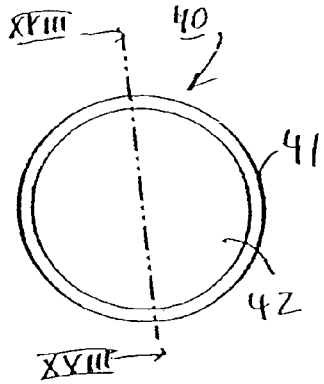
FIG. 17 is a top plan view of the base of FIG. 16.
Figure 18:
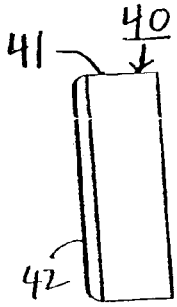
FIG. 18 is a sectional view along line XVIII—XVIII of FIG. 17.

Base 40 is more particularly illustrated in FIGS. 16–18. It includes a cylindrical sidewall 41 closed at the bottom by a bottom wall 42. Sidewall 41 is sized so as to be received over the lower end of the outer container 30 with a friction fit and to cover the ampule sockets defined by the two pairs of recesses 32, 33 and 34, 35, respectively.

Figure 19:
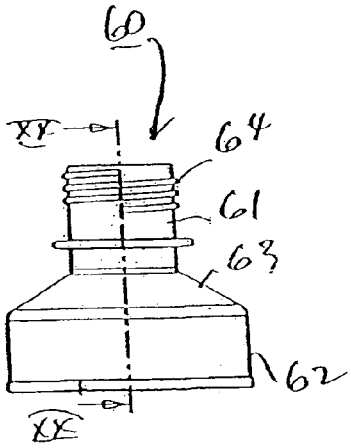
FIG. 19 is a side-elevational view of the intermediate coupling member in the device of FIGS. 1–4.
Figure 20:
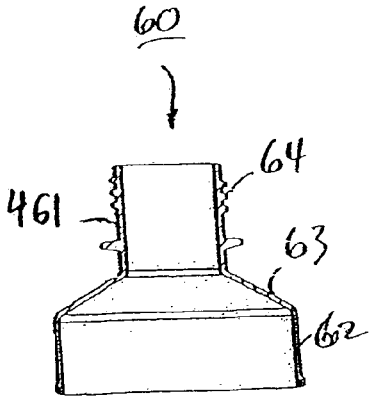
FIG. 20 is a sectional view along line XX—XX of FIG. 19.
Figure 21:
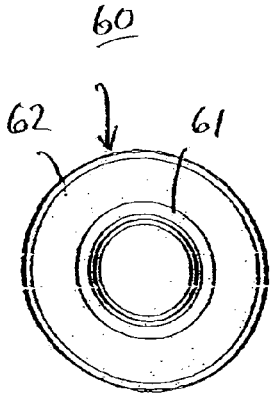
FIG. 21 is a bottom plan view of the intermediate coupling member of FIGS. 19 and 20.
Figure 22:
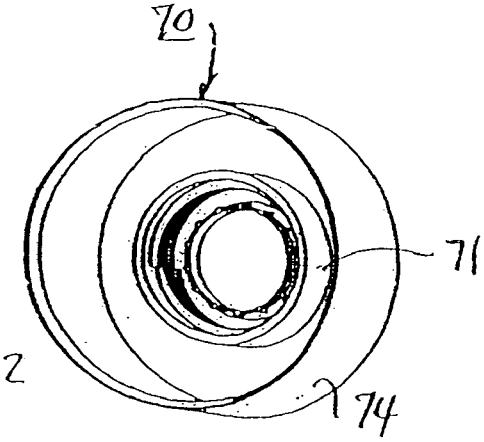
FIG. 22 is a three-dimensional view of the outer cap assembly in the device of FIGS. 1–4.
Figure 23:
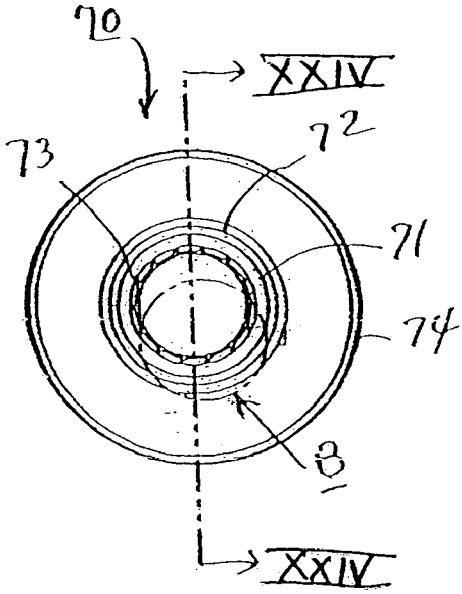
FIG. 23 is a bottom plan view of the outer cap assembly of FIG. 22.
Figure 24:
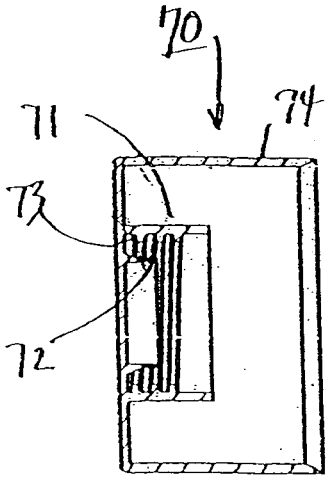
FIG. 24 is a sectional view along line XXIV—XXIV of FIG. 23.
Figure 25:
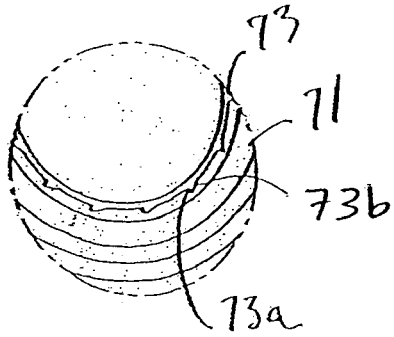
FIG. 25 is an enlarged fragmentary view of the region marked B in FIG. 23.

Intermediate coupling member 60 which, as indicated above, serves as a coupling between the inner container 20 and the outer cap assembly 70, is more particularly shown in FIGS. 19–21. It includes a cylindrical coupling 61 sized to be insertable over neck 24 of the inner container 20 and to be firmly retained thereon with a friction fit by engaging the annular ribs 24*a*, 24*b* on the outer surface of the neck. Intermediate coupling member 60 further includes a cover 62 sized to cover the upper end of the outer container 30 when the coupling member is applied to the inner container 20. Cover 62 is joined to coupling 61 by aconical juncture 63, generally conforming to the shape of conical juncture 23 between the inner conitainer 20 and its neck 24. The outer surface of coupling 61 is formed with threads 64 for receiving the outer cap assembly 70.

The outer cap assembly 70 is more particularly illustrated in FIGS. 22–25. It includes a cap 71 formed on its inner surface with threads 72 receivable over threads 64 of the intermediate coupling member 60 for attaching the outer cap assembly to the inner coupling member. In addition, the outer end of cap 71 is formed with one-way coupling teeth 73 cooperable with teeth 25 formed in neck 24 of the inner container 20. Teeth 73 in cap 71 are of a similar configuration as described above with respect to teeth 25 in neck 24 such that rotation of the cap in one direction effects a coupling with the inner container 20 but rotation of the cap in the opposite direction does not effect a coupling with the inner container. Thus, after the cap assembly has been threaded onto the intermediate coupling member 60, rotating the cap assembly in one direction first rotates the inner container 20, to thereby cause its projection 22 to engage and rupture the ampules 51 within compartment 50. Continued rotation of the cap assembly in the same direction clears its teeth with those on the inner container 20, and thereby perimits removal of the cap from the inner container. However, the cap assembly may be freely rotate in the opposite direction to permit it to be reapplied to the inner container.

The outer cap assembly 70 illustrated in FIGS. 22–25 further includes a rotatable knob 74 of larger diameter than cap 71 and enclosing the cap. Knob 74 is preferably of the same diameter as the outer container 30 to thereby facilitate the rotation of cap 71, and also to produce a flush appearance with the outer container 30.

The manner of using the described chemiluminscent device will be apparent from the above description. Thus, with base 40 removed from the outer container 30, the ampules 51–54 filled with one chemiluminscent fluid, may be conveniently inserted into their respective sockets defined by the two pairs of recesses 32, 33 and 34, 35 in the lower part of the outer container 20. For example, annular space 31 may contain one chemiluminscent fluid, and each socket may receive two ampules containing the other chemiluminscent fluid to be mixed with that in annular space 31 in order to produce the chemiluminscent reaction.

After the device has thus been loaded with the chemiluminscent ampules, base 40 is reapplied to the bottom end of the outer container 30. The inner container 20, filled with the appropriate beverage or other liquid, may then be inserted into the outer container 30. The intermediate coupling 60 may then be applied by a press fit over neck 24 of the inner container 20. The annular space 31 may then be filled with its chemiluminscent fluid. Finally, the outer cap assembly 70 may then be applied by threading the cap 71 about threads 64 of the intermediate coupling member 60 until teeth 73 of the outer cap assembly 70 become aligned with teeth 25 of the inner container 20.

Whenever it is desired to produce the chemiluminscent effect, the outer cap assembly 70 is rotated in the coupling direction, that is, wherein the perpendicular faces 73*a* of teeth 73 of cap 71 engage the perpendicular faces 25*a* of teeth 25 in the inner container neck 24, to thereby rotate the inner container with the rotation of the cap. This rotation of the inner container also rotates its projection 22 within compartment 50, whereby the opposed corners of the square projection 22 engage and rupture the capsules 51–54 within compartment 50. The rupture of the capsules releases the fluids therein. The released fluids mix with the fluid in annular space 31 and produce, by the chemiluminscent reaction, a luminescent liquid which rises, e.g., by capillary attraction and/or by expansion, within the space 31 between the outer container 30 and the inner container 20. A luminous glow is thus visible through the light-transmissive outer container 30.

When it is desired to pour-out some of the contents of the inner container 20, the outer cap assembly 70 is removed by rotating it in the same direction.

When it is desired to reapply the cap assembly, it is rotated in the opposite direction. In this case, the slanted faces 73*b* of teeth 73 in cap 71 of the outer cap assembly 70 engage the slanted faces 25*b* of teeth 25 in the inner container neck 24, such that the outer cap assembly is freely rotatable in the latter direction, to permit reattachment of the outer cap assembly to the inner container 20.

Figure 26:
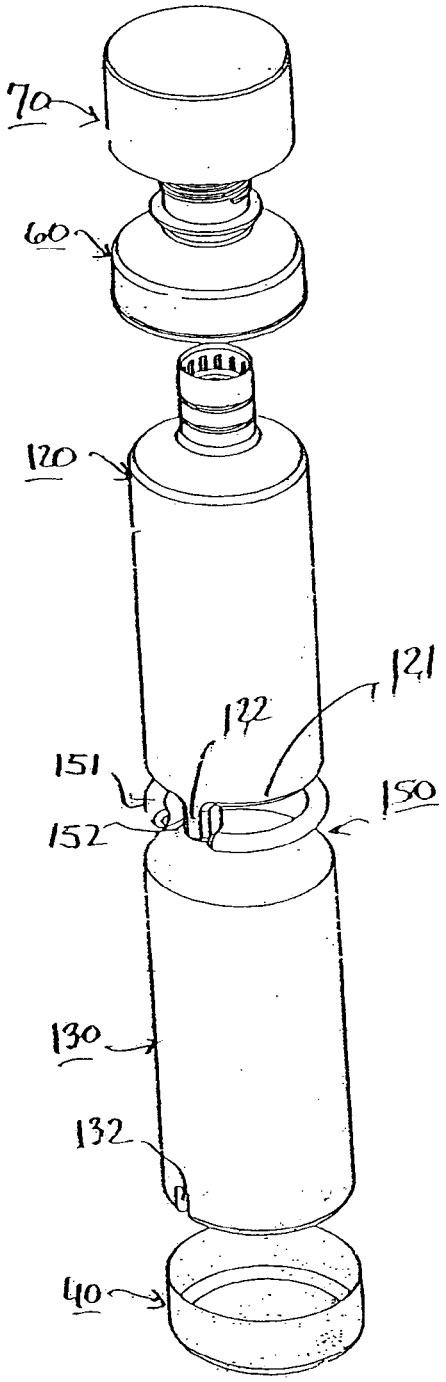
FIG. 26 is an exploded, three-dimensional view, illustrating another changeable-appearance device constructed in accordance with the present invention.
Figure 27:
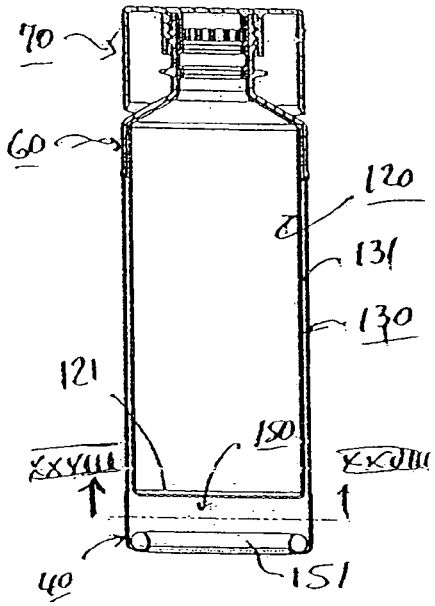
FIG. 27 is a longitudinal sectional view of the device of FIG. 26 in assembled condition.
Figure 28:
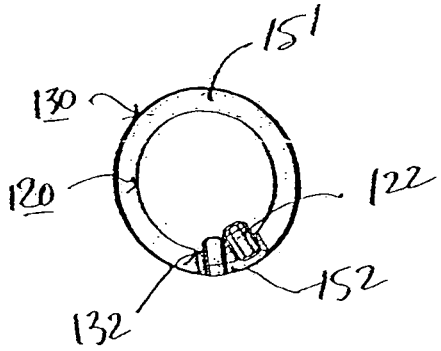
FIG. 28 is a transverse section view along line XXVIII—XXVIII of FIG. 27.

FIGS. 26–28 illustrate another changeable-appearance device constructed in accordance with the present invention. The changes in the device of FIGS. 26–28 over that in FIGS. 1–25 are mostly in the inner container, generally designated 120, in the outer container generally designated 130, and in the compartment 150 including the ampule 151 received therein. The base 40 for the outer container, the intermediate coupling member 60 attachable to the upper end of the inner container 20, and the outer cap assembly 70, are basically the same as in FIGS. 1–25, and are therefore identified by the same reference numerals.

As shown particularly in FIG. 26, the compartment 150 defined by the bottom wall 121 of the inner container 120, and the base 40 closing the bottom of the outer container 130, receives an ampule 151 of circular configuration, but formed with a gap 152 between its ends. The bottom wall 121 of the inner container 120 is formed with a projection 122, but in this case the projection is eccentric (off-center) with respect to the bottom wall, so as to be normally received within the gap 152 between the ends of the circular ampule 151. It will thus be seen that when the inner container 120 is rotated with respect to the outer container 130, projection 122 engages the ampule 151 to rupture it, and thereby to release its fluid to mix with the chemiluminscent fluid in the annular space 131 between containers 120 and 130, as described above with respect to FIGS. 1–25.

It will also be seen that the outer container 130 is provided, in its lower region, with a slot 132 to accommodate projection 122, and to permit it to engage ampule l51 upon the rotation of the inner container 120 with respect to the outer container 130.

In all other respects, the changeable-appearance device illustrated in FIGS. 26–28 is constructed, and operates, in the same manner as described above with respect to FIGS. 1–25.

While the invention has been described with respect to one preferred embodiment, it will be appreciated that many variations and other applications may be made. For example, the sockets for receiving the chemiluminscent ampules may be constructed in the base 40, rather than in the lower end of the outer container 30. In addition, the intermediate coupling member 60 and/or the outer cap assembly 70 may be omitted, such that the chemiluminscent effect is produced in a glass, cup or coaster, rather than in a bottle-type container. Further, the invention could be implemented in other ornamental type devices, wherein the ampules 51–54 are filled with colored fluids or other substances producing a desired colored, effervescent, or other appearance-changing effect, rather than chemiluminscent fluids producing a luminous effect.

In addition, the changeable-appearance fluid could one producing a color change when the inner container 120 is rotated with respect to the outer container 130, to thereby provide a tamper-proof bottle producing a clear indication that the bottle has previously been opened.

Many other variations, modifications and applications of the invention will be apparent to those skilled in the art.

What is claimed is:

1. An changeable-appearance device, comprising:

an inner container open at the top and closed at the bottom by a bottom wall;

and an outer light-transmissive container open at the top and sized for receiving said inner container with an annular space between the two containers, said outer container including a base closing the bottom of the outer container and defining a compartment with said bottom wall of the inner container for receiving at least one rupturable ampule containing a substance capable of producing a change in appearance of said device when the ampule is ruptured;

at least one of said containers including an ampule-engaging element located within said compartment and effective, upon rotation of one of said containers with respect to the other, to engage and rupture said ampule therein and thereby to release said appearance-changing substance into said annular space between the two containers.

2. The device according to claim 1, wherein said inner container includes said ampule-engaging element effective, upon rotation of one of said containers with respect to the other, to engage and rupture the ampule or ampules within said compartment.

3. The device according to claim 2, wherein said ampule-engaging element is a projection carried by said bottom wall of the inner container and projecting into said compartment.

4. The device according to claim 3, wherein said projection is carried centrally of the bottom wall of said inner container, and said compartment is configured to receive at least one ampule on each of two opposite sides of said projection carried by said bottom wall of the inner container.

5. The device according to claim 3, wherein said compartment is configured to receive an ampule of circular configuration but formed with a gap between its ends; and wherein said projection is carried eccentrically of the bottom wall of said inner container so as to be normally located in said gap.

6. The device according to claim 1, wherein the upper end of said inner container includes a neck, and wherein said device further comprises a cap threadably received on said neck of the inner container for opening and closing the inner container.

7. The device according to claim 6, wherein said neck and said cap are each formed with one-way coupling teeth configured such that rotation of the cap in one direction first rotates said inner container and causes it to rupture the ampule or ampules in said compartment, and then permits removal of the cap from said inner container; said cap being freely rotatable in the opposite direction to permit reapplication of the cap to the inner container.

8. The device according to claim 7, wherein said cap closing the neck of the inner container is carried by a cap assembly which includes a manually-graspable knob of larger diameter than said cap.

9. The device according to claim 8, wherein said device further comprises an intermediate coupling member between the neck of said inner container and said cap assembly, said intermediate coupling member including a cover to overlie and close the open end of said outer container.

10. The device according to claim 1, wherein said base is, separable from said outer container to permit introduction of an ampule or ampules into said compartment.

11. The device according to claim 10, wherein the lower end of said outer container, or said base, includes a socket for each ampule permitting insertion of the ampule or ampules after said base has been separated from the lower end of the outer container.

12. The device according to claim 1, wherein said compartment includes at least one ampule containing a fluid which, when released by the rupture of the ampule, produces an ornamental appearance to the device.

13. The device according to claim 12, wherein said fluid is a chemiluminscent liquid which, when released, produces a chemiluminscent glow in the device.

14. The device according to claim 12, wherein said fluid is an effervescent-producing fluid which, when released, produces an effervescent appearance in the device.

15. The device according to claim 12, wherein said fluid is a color-changing liquid which, when released, produces a color change in the device to indicate a previous opening of the device.

16. A chemiluminscent device, comprising:

an inner container open at the top to receive a beverage or other liquid, and closed at the bottom by a bottom wall;

an outer light-transmissive container open at the top and sized for receiving said inner container with an annular space between the two containers, said outer container including a base closing the bottom of the outer container and defining a compartment with said bottom wall of the inner container;

and at least one rupturable ampule insaid compartment and containing a chemiluminscent fluid;

one of said containers including an ampule-engaging element effective, upon rotation of one container with respect to the other container, to engage and rupture said ampule, and thereby to release said chemiluminscent fluid in said annular space between the two containers.

17. The device according to claim 16, wherein said inner container includes said ampule-engaging element effective, when the inner container is rotated with respect to the outer container, to engage and rupture said ampule, and thereby to release said chemiluminscent fluid into said annular space between the two containers.

18. The device according to claim 17, wherein said projection is carried centrally of the bottom wall of said inner container, and said compartment is configured to receive at least one ampule on each of two opposite sides of said projection carried by said bottom wall of the inner container.

19. The device according to claim 17, wherein said compartment is configured to receive an ampule of circular configuration but formed with a gap between its ends; and wherein said projection is carried eccentrically of the bottom wall of said inner container so as to be normally located in said gap.

20. The device according to claim 16, wherein said base is separable from said outer container to permit introduction of said ampule into said compartment.

21. The device according to claim 16, wherein the upper end of said inner container includes a neck, said device further comprising a cap threadably received on said neck of the inner container for opening and closing the inner container.

22. The device according to claim 21, wherein said neck and cap are each formed with one-way coupling teeth configured such that rotation of the cap in one direction first rotates said inner container and causes it to rupture said ampule, and then permits removal of the cap from said inner container; said cap being freely rotatable in the opposite direction to permit reapplication of the cap to the inner container.

23. The device according to claim 22, wherein said cap closing the neck of the inner container is carried by a cap assembly which includes a manually-graspable knob of larger diameter than said cap.

24. The device according to claim 23, wherein said device further comprises an intermediate coupling member between the neck of said inner container and said cap assembly, said intermediate coupling member including a cover to overlie and close the open end of said outer container.

* * * * *